US006120832A

United States Patent [19]

Walsh et al.

[11] Patent Number: 6,120,832

[45] Date of Patent: Sep. 19, 2000

[54] METHOD AND APPARATUS FOR MEASURING THE TRANSFER EFFICIENCY OF A COATING MATERIAL

[75] Inventors: Paul P. Walsh, Mentor; Charles F. Williams, Strongsville, both of Ohio

[73] Assignee: The Lubrizol Corporation, Wickliffe, Ohio

[21] Appl. No.: 09/199,499

[22] Filed: Nov. 25, 1998

[51] Int. Cl.[7] ..... B05D 1/04

[52] U.S. Cl. ..... 427/8; 427/475; 427/483; 427/486; 118/624; 118/688; 118/692

[58] Field of Search ..... 427/8, 475, 485, 427/486, 483; 118/668, 692, 308, 629, 323

[56] References Cited

U.S. PATENT DOCUMENTS

| | | | |
|---|---|---|---|
| 3,741,789 | 6/1973 | Young et al. | 117/16 |
| 3,793,049 | 2/1974 | Probst . | |
| 3,801,349 | 4/1974 | Wilson et al. | 117/31 |
| 3,934,055 | 1/1976 | Tamny | 427/8 |
| 4,048,956 | 9/1977 | Estebanez et al. . | |
| 4,133,290 | 1/1979 | Melliger . | |
| 4,517,219 | 5/1985 | Hajek | 427/8 |
| 4,622,449 | 11/1986 | Inoue | 219/69 |
| 4,704,297 | 11/1987 | Binns et al. | 427/9 |
| 4,816,285 | 3/1989 | Ribnitz | 427/10 |
| 5,073,579 | 12/1991 | Macholdt et al. | 524/255 |
| 5,348,774 | 9/1994 | Golecki et al. . | |
| 5,539,322 | 7/1996 | Zoughi et al. | 324/644 |
| 5,567,468 | 10/1996 | Lucas | 427/9 |
| 5,654,042 | 8/1997 | Watanabe et al. . | |
| 5,743,958 | 4/1998 | Shutic . | |
| 5,976,612 | 11/1999 | Tardoni . | |
| 5,993,892 | 11/1999 | Wasserman et al. . | |
| 6,045,056 | 4/2000 | Tardoni . | |

FOREIGN PATENT DOCUMENTS

| | | |
|---|---|---|
| 2 253 164 | 2/1992 | United Kingdom . |

*Primary Examiner*—Fred J. Parker
*Attorney, Agent, or Firm*—Samuel B. Laferty; Michael F. Esposito

[57] ABSTRACT

A method and apparatus for measuring the transfer efficiency during the electrostatic spraying of a coating material (e.g. powder coating) is provided. The transfer efficiency can be measured during the test cycle rather than measuring an average transfer efficiency for an electrostatic spray cycle. A cycle may include the initial time when the substrate is "uncoated or clean" and an end point of the test when electrical insulating effects caused by accumulated powder on the substrate lead to a reduction in the transfer efficiency. The method uses computer based calculation software and a computer. The computer is connected to load cells that measure weight changes of a target substrate and a vessel containing the coating material to be sprayed.

25 Claims, 2 Drawing Sheets

METHOD AND APPARATUS FOR MEASURING THE TRANSFER EFFICIENCY OF A COATING MATERIAL

TECHNICAL FIELD

This invention relates to a method and apparatus for measuring the transfer efficiency of a coating material. This method and apparatus is suitable for measuring the transfer efficiency of any coating material, but is particularly suitable for measuring the transfer efficiency of a powder coating material.

BACKGROUND OF THE INVENTION

In a typical powder coating spray process, not all of the coating material that is sprayed adheres to the target substrate. The amount of powder coating material that actually ends up applied to the target substrate is a function of the transfer efficiency of the coating material. The average transfer efficiency for a coating material can be calculated by dividing the change in weight of the target substrate by the change in weight of the powder coating source dispensing the powder coating material. The transfer efficiency is conveniently expressed as a percentage of the powder coating material that adheres to the target substrate relative to the powder coating material that is sprayed.

The current practice is to measure the average transfer efficiency of a powder coating material by measuring the starting and ending weight of the target substrate and the total amount of powder sprayed. This is a time consuming, manually-intensive procedure. Moreover, this procedure does not measure the true transfer efficiency of a powder coating material due to the fact that the transfer efficiency values observed tend to vary over the course of the test cycle. In this regard, the transfer efficiency values observed with an uncoated or clean substrate at the beginning of the test are typically higher than at the end of the test when the substrate is coated. This is at least in part due to electrical insulating affects that result from accumulated powder on the target substrate. Until now it has not been possible to measure instantaneous transfer efficiency values at anytime during the test cycle, and this has prevented researchers from measuring the true transfer efficiency values of powder coating materials.

The present invention overcomes these problems by providing a method for measuring instantaneous transfer efficiency values of coating materials at any time during a test cycle. This permits measurement of the true transfer efficiency values of such coating materials. The term "true transfer efficiency value" is the transfer efficiency value of a coating material that is measured after start up of the test when the substrate is no longer "uncoated or clean" and prior to the point at the end of the test when electrical insulating affects caused by accumulated powder on the substrate lead to a deterioration or reduction in the observed transfer efficiency value.

SUMMARY OF THE INVENTION

This invention relates to a method for measuring the transfer efficiency of a coating material, the method comprising:

(A) electrostatically spraying said coating material on to a target substrate, the coating material being drawn from a coating source during said spraying; and performing steps (B), (C) and (D) during step (A);

step (B) comprising measuring the change in weight of the target substrate;

step (C) comprising measuring the change in weight of the coating source; and step (D) comprising calculating the transfer efficiency of the coating material by dividing the change in weight of the target substrate measured in step (B) by the change in weight of the coating source measured in step (C), the number of measurements in each of steps (B) and (C) and the number of calculations of transfer efficiency in step (D) ranging from about 1 per 5 seconds to about 500 per second.

The invention also relates to an apparatus, comprising:

an electrostatic spray gun for spraying a coating material;

a target substrate positioned in spaced relationship from said spray gun for receiving coating material sprayed from said spray gun;

a load cell adapted to generate electrical signals indicative of the weight of said target substrate;

a vessel for containing said coating material, said vessel being connected to said spray gun through a tubular connector, the tubular connector being adapted to convey said coating material from said vessel to said spray gun;

another load cell adapted to generate electrical signals indicative of the weight of said vessel;

said load cell and said another load cell being linked to a computer to permit the computer to (1) receive said electrical signals indicative of the weight of said vessel and said electrical signals indicative of the weight of said target substrate, (2) calculate changes in the weight of said vessel and changes in weight of said substrate as coating material is drawn from said vessel and sprayed on to said target substrate using said spray gun, and (3) calculate the transfer efficiency of the coating material by dividing the change in weight of said target substrate by the change in weight of said vessel.

BRIEF DESCRIPTION OF THE DRAWINGS

In the annexed drawings, like parts and features are identified by like references.

DESCRIPTION OF THE PREFERRED EMBODIMENTS

Figure 1:
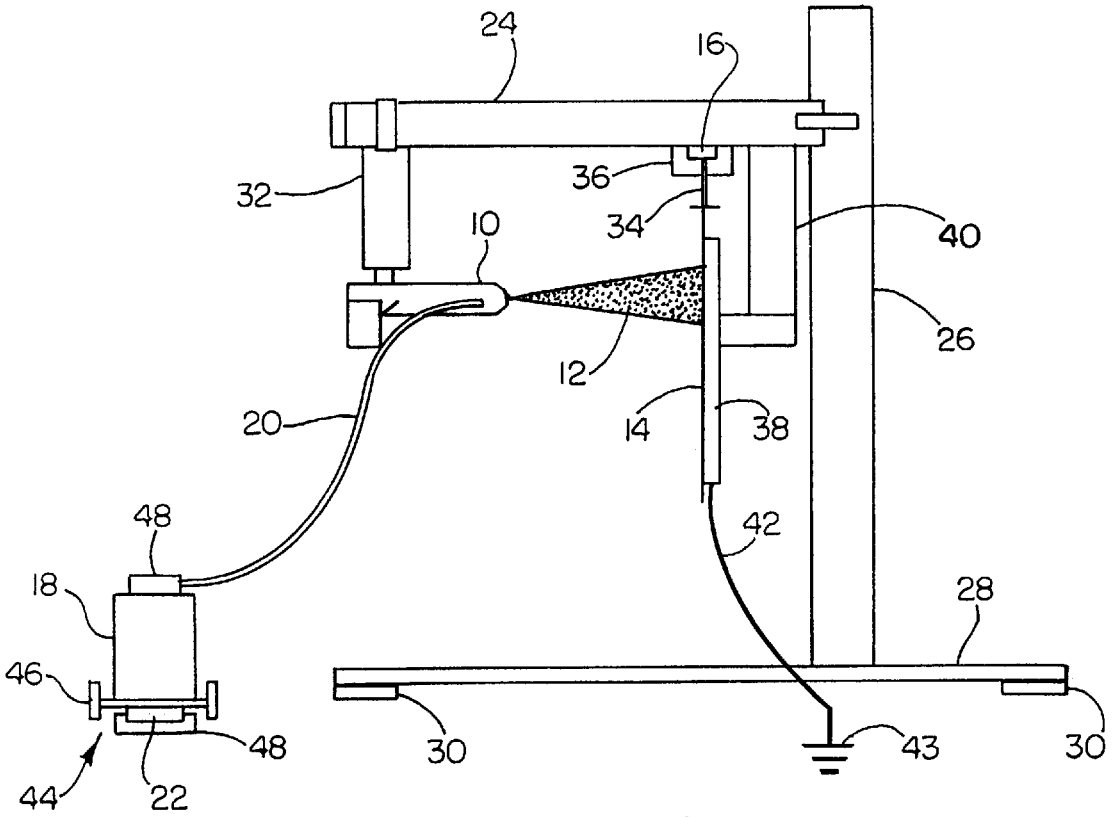
FIG. 1 is a schematic illustration of a side view of one embodiment of the inventive apparatus, wherein the spray gun is stationary relative to the target substrate.

The inventive method may be performed using the inventive apparatus illustrated in FIG. 1. Referring to FIG. 1, the apparatus, in its illustrated embodiment, is comprised of an electrostatic spray gun 10 for spraying a coating material 12; a target substrate 14 positioned in spaced relationship from the spray gun 10 for receiving coating material 12 sprayed from spray gun 10; a load cell 16 communicating with the substrate 14 and adapted to generate electrical signals indicative of the weight of substrate 14; and a vessel 18 for containing the coating material 12. The vessel 18 is connected to spray gun 10 through a tubular connector 20, the tubular connector 20 being adapted to convey coating material 12 from vessel 18 to the spray gun 10. Vessel 18 communicates with another load cell 22 which is adapted to generate electrical signals indicative of the weight of the vessel 18.

The load cells 16 and 22 are linked to a computer (not shown in the drawings) and transmit electrical signals to the computer to permit the computer to (1) receive electrical signals indicative of the weight of vessel 18 and electrical signals indicative of the weight of the substrate 14, (2) calculate changes in the weight of the vessel 18 and changes in weight of the substrate 14 as coating material 12 is drawn form vessel 18 and sprayed on to substrate 14 using said spray gun 10, and (3) calculate the transfer efficiency of the coating material 12 by dividing the change in weight of the substrate 14 by the change in weight of the vessel 18.

The spray gun 10 and the target substrate 14 are attached to and depend from cantilevered arm 24. Cantilevered arm 24 is mounted on and projects outwardly from vertical support member 26. Vertical support member 26 is mounted on and projects upwardly from base plate member 28. Base plate member 28 is supported by vibration isolators 30.

Spray gun 10 is attached to bracket 32 which is slidably mounted on cantilevered arm 24. The position of spray gun 10 relative to the position of target substrate 14 can be varied by moving spray gun 10 and bracket 32 to the left or to the right (as depicted in FIG. 1) along cantilevered arm 24. By doing this, the distance between the spray gun 10 and the target substrate 14, and as result the distance the coating material is sprayed, can be varied. In one embodiment, the distance between the spray head of spray gun 10 and target substrate 14 is from about 1 to about 60 inches, and in one embodiment about 1 to about 40 inches, and in one embodiment about 2 to about 30 inches, and in one embodiment about 4 to about 20 inches, and in one embodiment about 4 to about 18 inches, and in one embodiment about 6 to about 12 inches.

Target substrate 14 communicates with load cell 16. Load cell 16 is attached to and depends from cantilevered arm 24. Load cell 16 is a tension load cell which has an operating range suitable for the size and weight of the target substrate 14 and the anticipated weight of the coating material 12 to be sprayed on to the target substrate. In one embodiment, the load cell 16 has a 0–250 gram range with precision of ±0.01 gram. Target substrate 14 is connected to load cell 16 through non-conductive cable connector 34. Deflection cowling 36 surrounds load cell 16 and isolates it from coating material 12 that is sprayed during the test procedure and from flowing air. Backing plate 38 is positioned adjacent to target substrate 14 and prevents substrate 14 from movement to the right (as depicted in FIG. 1) during the spraying of coating material 12 onto substrate 14. Backing plate 38 can be made of a suitable low-surface energy material that does not interfere the measurements of weight change for target substrate 14. An example of such a low-surface energy material is Teflon™. Backing plate 38 is mounted on L shaped support member 40. Support member 40 is attached to and depends from cantilevered arm 24. Ground wire 42 is connected to backing plate 38 and runs to a convenient grounding location 43.

Target substrate 14 can have any desired shape or size and can be made of any conductive material. The term "conductive material" is used herein to refer to any material having a resistance equal to or less than $10^{10}$ ohms per square centimeter. The target substrate 14 can be made of metal, wood, plastic, or a combination thereof, with metal substrates being preferred. The substrate can be a flat panel or it can have a three-dimensional shape. The substrate 14 can have the shape of any object or part (e.g., automotive door panel, molded part, etc.) that can be spray coated. In one embodiment, the target substrate is an aluminum sheet test panel having the dimensions of about 6×6 inches to about 36×36 inches, and in one embodiment about 12×12 inches.

Figure 2:
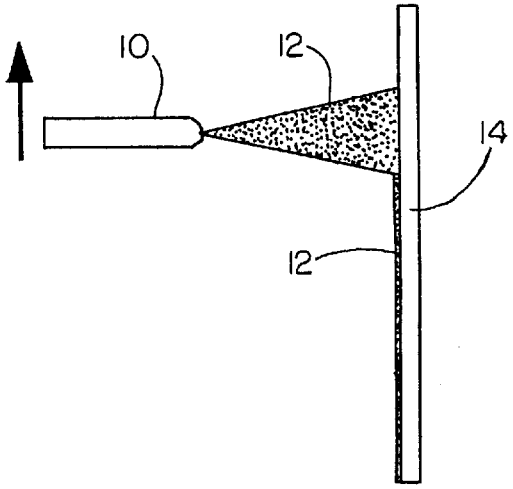
FIG. 2 is a schematic illustration of a partial top plan view of an alternative embodiment of the inventive apparatus, wherein the spray gun is movable relative to the target substrate.

In the embodiment depicted in FIG. 1, the spray gun 10 and the target substrate 14 are stationary relative to each other during the operation of the test procedure. However, those skilled in the art will recognize that the apparatus can be modified to permit the spray gun 10 and/or target substrate 14 to move relative to the other during operation of the test procedure. In one embodiment, the spray gun 10 is moveable relative to the target substrate 14. This is illustrated in FIG. 2. Referring to FIG. 2, the spray gun 10 is moving from right to left (as viewed from overhead) during spraying while the target substrate 14 remains in a fixed position. It will also be recognized that mounting bracket 32 can be modified to permit a pivotal movement of spray gun 10 during spraying.

Vessel 18 is mounted on load cell assembly 44 which includes load cell 22, upper support plate 46 and lower support plate 48. Load cell 22 is a compression load cell which typically has a 0–5 kilogram capacity. Vessel 18 can be any enclosed vessel suitable for holding coating material 12 during the test procedure. Vessel 18 includes a pump 48 for transporting the coating material 12 from vessel 18 to spray gun 10. In one embodiment, the coating material 12 is a powder coating material, and vessel 18 is a fluidized bed dispenser. In this embodiment, the fluidizing pressure is typically about 8 to about 15 psig, and in one embodiment about 8 to about 10 psig. The powder delivery pressure (i.e., the pressure used to advance the powder throught tubular connector 20) is typically about 5 to about 50 psig, and in one embodiment about 5 to about 30 psig, and in one embodiment about 5 to about 15 psig, and in one embodiment about 10 psig.

The electrostatic spray gun 10 can be an electrostatic corona gun or an electrostatic tribo charging gun. The spray gun typically operates with a voltage potential of up to about 100 kilovolts, and in one embodiment about 60 to about 100 kilovolts, and in one embodiment about 80 kilovolts. The spray-gun typically uses air to atomize the coating material 12 being sprayed, the atomizing pressure typically being about 5 to about 15 psig, and in one embodiment about 10 psig. The flow rate of the coating material 12 through the spray gun 10 is typically about 10 micrograms to about 5 grams per second, and in one embodiment about 0.1 to about 5 grams per second, and in one embodiment about 0.2 to about 5 grams per second, and in one embodiment about 0.5 to about 5 grams per second, and in one embodiment about 0.5 to about 3 grams per second, and in one embodiment about 1 gram per second. The duration of the spraying for a typical test procedure is about 5 to about 120 seconds, and in one embodiment about 10 to about 90 seconds, and in one embodiment about 15 to about 60 seconds and in one embodiment about 20 to about 40 seconds.

The coating material can be any sprayable material including paint, shellac, varnish, ink and the like. These include water-based paint and coating materials as well as solvent-based painting and coating materials. The coating material can be an ink coating composition, including water-based, solvent based or radiation-cured (e.g., UV-cured) ink coating compositions. The coating material can be a lubricating oil or a grease. In a particularly advantageous embodiment of the invention, the coating material is a powder coating material. The average particle size of the sprayed coating material is from about 0.1 to about 200 microns, and in one embodiment about 1 to about 100 microns, and in one embodiment about 5 to about 100 microns, and in one embodiment about 10 to about 100 microns, and in one embodiment about 15 to about 100 microns, and in one embodiment about 25 to about 75 microns.

The apparatus depicted in FIG. 1 is typically mounted within a spray booth enclosure (not shown in the drawings) to contain overspray and to comply with environmental concerns. The air flow induced by the spray booth fan typically provides an air flow velocity in the direction of the spraying in the range of up to about 200 feet per minute, and in one embodiment up to about 150 feet per minute, and in one embodiment in the range of about 60 to about 100 feet per minute.

The computer and computer software can be any combination of hardware and software capable of (1) receiving electrical signals from load cell 22 indicative of the weight of vessel 18 and electrical signals from load cell 16 indicative of the weight of target substrate 14, (2) calculating changes in the weight of vessel 18 and changes in the weight of substrate 14 as coating material 12 is drawn from vessel 18 and sprayed on to substrate 14 using spray gun 10, and (3) calculating the transfer efficiency of the coating material 12 by dividing the change in weight of substrate 14 by the change in weight of vessel 18. The number of calculations of transfer efficiency the computer hardware and software must handle are in the range of about 1 calculation per 5 seconds to about 500 calculations per second, and in one embodiment about 1 to about 100 calculations per seconds, and in one embodiment about 1 to about 50 calculations per second, and in one embodiment about 1 to about 25 calculations per second, and in one embodiment about 5 to about 15 calculations per second, and in one embodiment about 10 calculations per second. An example of the computer hardware that can be used is an IBM-80486 PC machine (66 MHZ) NT compatible software with at least 8 MB RAM capable of spreadsheet and multi-tasking functions. An example of the software that can be used is ACR Systems Inc. British Columbia, Canada Trendreader® software #TR-WIN-SRP with 12 bit resolution Excel 7.0 with appropriate visual-basic macro code used for data tabulation. The computer hardware and software are capable of providing a plot of instantaneous transfer efficiency values versus time over the duration of the spray test procedure.

The following example is provided to further illustrate the invention.

EXAMPLE 1

A powder coating material 12 is sprayed on to a target substrate 14 under following conditions using the apparatus depicted in FIG. 1:

Spray gun: Nordson Corp., Westlake, Ohio. Versa-Spray® II Model No. 173125A.

Target substrate: 12×12 inch 3000 series aluminum panel.

Powder coating material: Polyester urethane resin based powder coating material having average particle size of 35–45 microns.

Load cell 16: Sensotec Inc., Model No. AL311AN (250 gram load cell).

Load cell 22: Sensotec Inc., Model No. 41-0838-02-3 (10 pound load cell).

Vessel 18: Nordson Corp., Model No. HR-1-4.

Load Cell Amplifier: Daytronics Corp., Model No. 3270.

Spray Gun Amplifier: Nordson Corp., Model No. 173096A.

Data Logger: ACR Systems, Model No. 01-0014 Process Signal Logger.

Fluidizing pressure: 8–10 psig.

Powder delivery pressure: 10 psig.

Atomizing air pressure: 10 psig.

Spray gun voltage: 80 kilovolts.

Powder flow rate: 1 gram per second.

Spray gun to target substrate distance: 12 inches.

Spray duration: 30 seconds.

Transfer efficiency calculations: 10 per second.

Air flow rate: 150 ft/min.

Computer: IBM-80486 PC machine (66 MHZ) NT compatible software with at least 8 MB RAM capable of spreadsheet and multi-tasking functions.

Software: ACR Systems Inc. Trendreader® software #TR-WIN-SRP with 12 bit resolution Excel 7.0 with visual-basic macro code used for data tabulation.

Figure 3:
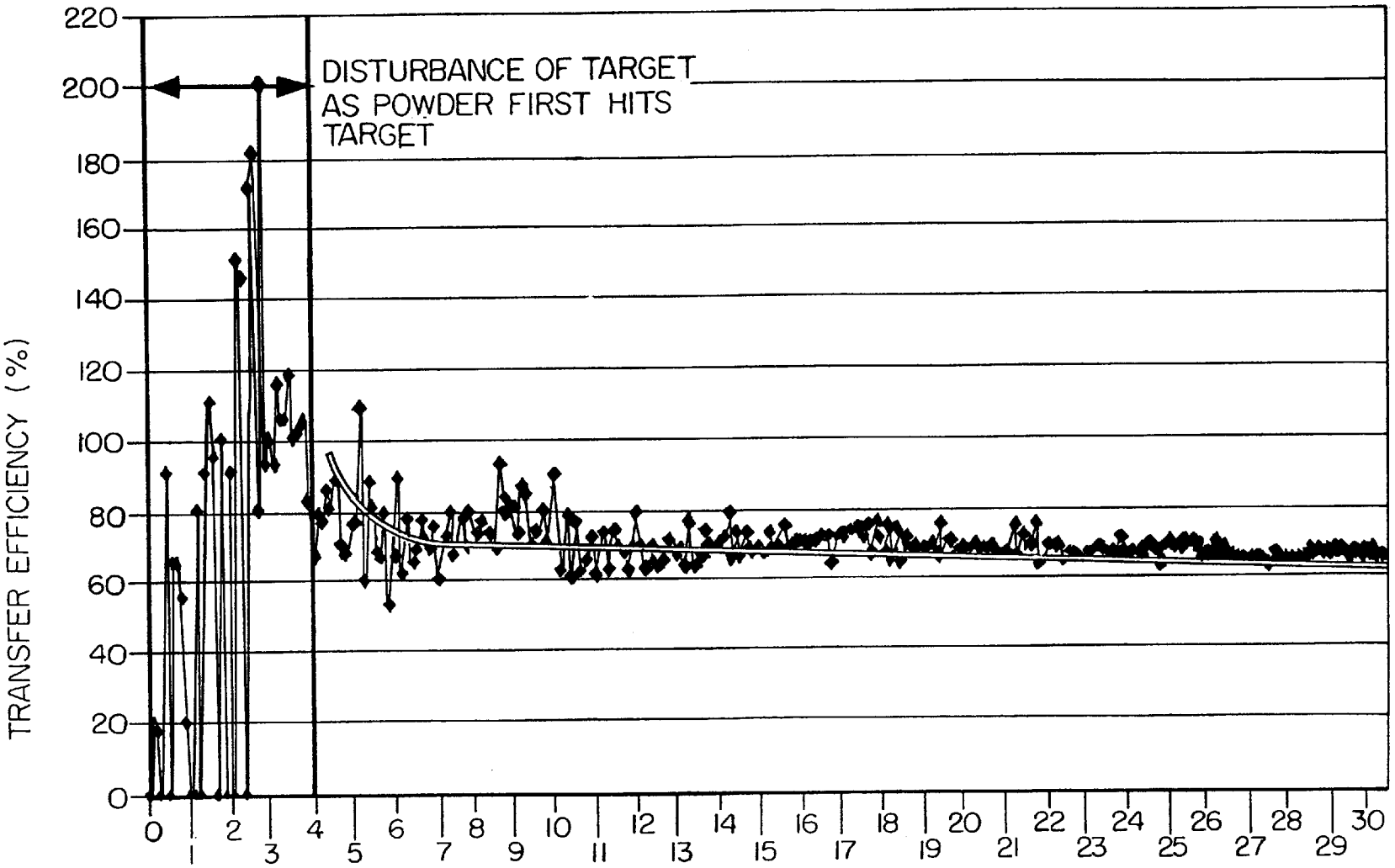
FIG. 3 is a plot of instantaneous transfer efficiency values versus time for the spray process disclosed in Example 1.

The results are plotted in FIG. 3 which is a plot of instantaneous transfer efficiency values versus time for the tested powder coating material. The line drawn through the plot extending from 4 to 30 seconds indicates that the instantaneous transfer efficiency values measured early in the test cycle (e.g., at 10 seconds into the test) are approximately the same as those measured late in the test cycle (e.g., at 28–30 seconds into the test). This indicates that the true transfer efficiency value of the coating material can be determined with the data in this range. The true transfer efficiency value of the coating material is the transfer efficiency that is measured after the plot of instantaneous transfer efficiency values versus time stabilizes or flattens out and prior to any significant downtrend (not shown in FIG. 3) resulting from electrical insulating affects caused by accumulating coating material on the target substrate. Stabilization of the curve in FIG. 3 occurs at about 10 seconds into the test. The true transfer efficiency value for the coating material tested in this example is 65%–70%.

An advantage of this invention is that it provides a measure of the true transfer efficiency value of coating materials. The inventive method is useful as a screen test for evaluating coating formulations and additives for such formulations. This method permits the user to identify coating formulations that increase electrostatic attraction, reduce back-ionization tendencies, and produce superior film properties (gloss, adhesion, friction control, etc.).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for measuring the transfer efficiency of a coating material, the method comprising:

(A) electrostatically spraying said coating material on to a target substrate connected to a first load cell for generating output indicative of the weight of the substrate, the coating material being drawn from a coating source during said spraying; said coating source communicating with a second load cell for generating output indicative of the weight of the coating source; and performing steps (B), (C) and (D) during step (A);

step (B) comprising measuring the change in weight of the target substrate using output from said first load cell;

step (C) comprising measuring the change in weight of the coating source using output from said second load cell; and step (D) comprising calculating the transfer efficiency of the coating material by dividing the change in weight of the target substrate measured in step (B) by the change in weight of the coating source measured in step (C), the number of measurements in each of steps (B) and (C) and the number of calculations of transfer efficiency in step (D) ranging from about 1 per 5 seconds to about 500 per second.

2. The method of claim 1 wherein said coating material is a water or other solvent-based coating material, an ink, a lubricant, a grease, or a powder coating material.

3. The method of claim 1 wherein said coating material is a powder coating material.

4. The method of claim 1 wherein the electrostatic spraying is conducted using an electrostatic spray gun.

5. The method of claim 4 wherein said spray gun is an electrostatic corona gun or electrostatic tribo charging gun.

6. The method of claim 4 wherein a voltage potential of up to about 100 kilovolts is applied to said spray gun.

7. The method of claim 1 wherein said target substrate is maintained at a ground potential.

8. The method of claim 1 wherein said coating source is comprised of a fluidized bed contained within a vessel.

9. The method of claim 1 wherein said target substrate is comprised of a conductive substrate.

10. The method of claim 1 wherein the change in weight of said substrate measured in step (B) is measured using a tension load cell.

11. The method of claim 1 wherein the change in weight of said coating source measured in step (C) is measured using a compression load cell.

12. The method of claim 4 wherein said spray gun comprises a spray head and the distance between said spray head and said target substrate is from about 1 to about 60 inches.

13. The method of claim 1 wherein said target substrate is comprised of metal, plastic, wood, or a combination thereof.

14. The method of claim 1 wherein air flows in the direction said coating material is sprayed during step (A), the velocity of said air being up to about 150 feet per minute.

15. The method of claim 1 wherein about 10 micrograms to about 5 grams of coating material are sprayed per second during step (A).

16. The method of claim 1 wherein the average particle size of said coating material sprayed during step (A) is from about 0.1 to about 200 microns.

17. The method of claim 1 wherein the number of measurements in each of steps (B) and (C) and the number of calculations of the transfer efficiency made during step (D) is in the range of about 1 to about 100 per second.

18. The method of claim 1 wherein the calculations of transfer efficiency made during step (D) are made using a computer.

19. An apparatus, comprising:

an electrostatic spray gun for spraying a coating material;

a target substrate positioned in spaced relationship from said spray gun for receiving coating material sprayed from said spray gun;

load cell adapted to be in communication with said substrate and generate electrical signals indicative of the weight of said substrate;

a vessel for containing said coating material, said vessel being connected to said spray gun through a tubular connector, the tubular connector being adapted to convey said coating material from said vessel to said spray gun;

another load cell adapted to be in communication with said vessel and generate electrical signals indicative of the weight of said vessel;

said load cell and said another load cell being linked to a computer to permit the computer to (1) receive said electrical signals indicative of the weight of said vessel and said electrical signals indicative of the weight of said target substrate, (2) calculate changes in the weight of said vessel and changes in weight of said target substrate as coating material is drawn from said vessel and sprayed on to said target substrate using said spray gun, and (3) calculate the transfer efficiency of the coating material by dividing the change in weight of said target substrate by the change in weight of said vessel.

20. The apparatus of claim 19 wherein said spray gun is movable relative to said substrate.

21. The apparatus of claim 19 wherein said substrate is movable relative to said spray gun.

22. The apparatus of claim 19 wherein said spray gun is an electrostatic corona gun or electrostatic tribo charging gun.

23. The apparatus of claim 19 wherein said spray gun is suitable for spraying a powder coating material.

24. The apparatus of claim 19 wherein said spray gun comprises a spray head and wherein the distance between said spray head and said target substrate is from about 1 to about 60 inches.

25. The apparatus of claim 19 wherein the computer includes computer software configured such that the transfer efficiency can be calculated by said computer within a range from about 1 time every 5 seconds to about 500 times per second.

* * * * *